US008322530B2

(12) United States Patent
Furlong

(10) Patent No.: US 8,322,530 B2
(45) **Date of Patent: *Dec. 4, 2012**

(54) STORAGE CONTAINER AND CONTAINER SYSTEM

(75) Inventor: Brian D. Furlong, Davidson, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 847 days.

This patent is subject to a terminal disclaimer.

(21) Appl. No.: 12/349,351

(22) Filed: Jan. 6, 2009

(65) Prior Publication Data

US 2009/0173656 A1 Jul. 9, 2009

Related U.S. Application Data

(63) Continuation-in-part of application No. 11/673,378, filed on Feb. 9, 2007.

(60) Provisional application No. 60/771,658, filed on Feb. 9, 2006.

(51) Int. Cl.
*B65D 21/00* (2006.01)
*B65D 85/62* (2006.01)
*B65D 43/03* (2006.01)

(52) U.S. Cl. ..... 206/508; 206/509; 220/781

(58) Field of Classification Search ..... 220/514, 220/781, 802, 350, 796, 641, 630, 23.86, 220/380; 206/508, 509, 908, 514, 515, 516, 206/519; 215/323

See application file for complete search history.

(56) References Cited

U.S. PATENT DOCUMENTS 2,412,325 A 12/1946 Devine et al.
3,112,841 A * 12/1963 Martinelli ..... 220/380
3,137,409 A 6/1964 Davis (Continued)

FOREIGN PATENT DOCUMENTS

WO WO03/062070 7/2003

OTHER PUBLICATIONS

Product literature for Trouve food storage containers from www.savethelids.com; admitted prior art, May 3, 2007.

(Continued)

*Primary Examiner* — Bryon Gehman
*Assistant Examiner* — Shawn Braden
(74) *Attorney, Agent, or Firm* — Lempia Summerfield Katz LLC

(57) ABSTRACT

A storage container system has a plurality of container bases and lids. Each base has a bottom, a continuous side wall extending up from the bottom and terminating at a top edge, an interior storage space within the side wall above the bottom, and an open top bounded by the top edge. Each lid has a main panel section, a perimeter skirt around the main panel section, a top side, and a bottom side. Each lid is configured to close off the open top of any one of the plurality of container bases by connecting a part of the perimeter skirt to the side wall near the top edge. Each lid has a first connecting structure with a lid-to-lid component and a mating lid-to-lid component. Each lid-to-lid component is configured to connect to the mating lid-to-lid component on any other one of the plurality of lids to connect any two of the plurality of lids together. Each lid also has a lid-to-base component, which is part of a second connecting structure and is different from the first connecting structure components. Each base has a mating lid-to-base component of the second connecting structure. Each lid-to-base component is configured to connect to each mating lid-to-base component to connect any one of the plurality of lids to the bottom of any one of the plurality of container bases.

12 Claims, 11 Drawing Sheets

U.S. PATENT DOCUMENTS 3,722,731 A 3/1973 McCormick et al.
3,730,385 A 5/1973 Rost
3,784,052 A 1/1974 Edwards
3,989,142 A 11/1976 Gwilliam, Jr. et al.
4,082,184 A 4/1978 Hammer
4,127,189 A 11/1978 Shumrak et al.
4,183,446 A 1/1980 Davis
4,204,609 A 5/1980 Kuhn
4,407,426 A 10/1983 McLaren et al.
4,412,630 A 11/1983 Daenen
4,446,969 A 5/1984 Tyler
D277,632 S 2/1985 Staufenberg
4,685,582 A 8/1987 Pulciani et al.
4,700,842 A 10/1987 Grusin
4,703,857 A * 11/1987 Jahnen et al. ..... 206/503
4,804,092 A 2/1989 Jones
4,951,832 A 8/1990 Tenney et al.
5,184,745 A 2/1993 Havens et al.
5,220,999 A 6/1993 Goulette
5,312,011 A 5/1994 Fischer
D355,814 S 2/1995 Van Valkenburg et al.
5,409,126 A 4/1995 Demars
5,409,128 A 4/1995 Mitchell
5,586,656 A 12/1996 Abrums
5,692,617 A 12/1997 Adams
5,769,229 A 6/1998 Andress et al.
5,775,483 A 7/1998 Lown et al.
5,799,792 A 9/1998 Abrums
5,992,679 A 11/1999 Porchia et al.
D419,829 S 2/2000 Wilson et al.
D466,364 S 12/2002 Demore
D475,620 S 6/2003 Chen et al.
6,571,981 B2 6/2003 Rohlfs
6,685,049 B1 2/2004 Paladino
6,708,824 B2 3/2004 Sahm, III
6,729,472 B2 5/2004 Stucke et al.
6,796,430 B2 * 9/2004 Mercier et al. ..... 206/505
6,845,877 B2 * 1/2005 Diesterbeck ..... 220/782
6,886,694 B2 5/2005 McNeeley et al.
D507,155 S 7/2005 Gosen et al.
7,017,775 B2 * 3/2006 Zettle et al. ..... 220/781
7,261,219 B2 * 8/2007 Tucker et al. ..... 220/793
7,726,483 B2 * 6/2010 Ramanujam et al. ..... 206/508
2003/0019878 A1 * 1/2003 Scarabelli et al. ..... 220/796
2005/0109654 A1 5/2005 Kolar et al.
2007/0284276 A1 * 12/2007 Luttik et al. ..... 206/508

OTHER PUBLICATIONS

Product literature for Snap Saver food storage containers from www.snap-saver.com; admitted prior art, May 3, 2007.

* cited by examiner

STORAGE CONTAINER AND CONTAINER SYSTEM

RELATED APPLICATION DATA

This patent is a continuation-in-part of "Storage Container and Container System," U.S. patent application Ser. No. 11/673,378, which was filed on Feb. 9, 2007, and which claimed priority benefit of "Storage Container System," U.S. provisional application Ser. No. 60/771,658, which was filed on Feb. 9, 2006. The entire contents of these prior filed applications are hereby incorporated by reference.

BACKGROUND OF THE INVENTION

1. Field of the Disclosure

The present disclosure is generally directed to storage containers, and more particularly to a storage container and container system that includes multiple containers and multiple lids with snap features so that the lids and containers may be snapped together in various configurations either during use or during non-use.

2. Description of Related Art

Conventional storage containers, such as for storing food items, are commonly formed of generally or substantially rigid plastic configurations. Plastic containers of this type generally have a base and a lid that attaches to the base. The base typically has a bottom and a side wall that together define an interior storage space in the container. The lid can be attached to the base to cover the open top and to seal the storage space.

Such plastic containers are generally available in a variety of sizes to store or transport different volumes of food items. Each size container typically includes a corresponding lid sized to fit its associated container. A user will typically store empty containers in a kitchen cabinet or pantry area when not in use. When not being used, the lids often become separated from their associated container bases. Users have expressed frustration over lost or misplaced lids and the difficulty in finding the correct lid for a selected container.

Some known container systems include lids that attach to the bottom of their respective container bases to help manage the containers and lids by keeping the lids and their corresponding containers together. Such lids, when attached to the base bottoms, often hinder space efficient stacking and storage of multiple containers. However, the user still needs to find the specific lid for the corresponding container base when the lids and container bases become separated, such as during cleaning. This is because containers of one storage capacity typically have lids specifically sized for only those containers, and containers of another storage capacity typically have lids of a different size.

During normal use, a container base is typically filled with food items and covered with the lid. Users sometimes stack full containers for refrigerator storage or for transport to a location outside the home. However, the stacked containers tend to be unstable and can slide off of each other and become separated. This makes it difficult to keep the containers organized in refrigerated storage and difficult to transport. A known storage container system disclosed in U.S. Pat. No. 6,886,694, commonly assigned to the assignee of the present patent, employs a lid and base configuration whereby a base can rest on the lid of another container and register with the lid. However, the lid of the underlying base does not connect or attach to the base of the overlying container.

One example of a prior art container system is shown and described in U.S. Pat. No. 5,692,617 and includes a plurality of containers and a plurality of lids that can attach to one another in a variety of ways. Each lid includes opposed male and female fasteners centrally located with one fastener on each side of the lid. The lids are connectable as a stack by interconnecting adjacent male and female fasteners of adjacent lids. Additionally, a stack of lids can be attached to a stack of nested containers. Each container includes a female fastener, identical to the female fastener on the lids, located on its bottom surface. The stacked lids can be attached to the nested containers by snapping an exposed one of the aforementioned male lid fasteners to an exposed female fastener of the bottom of an exposed container. When full and in use, these containers could be stacked upon one another, but the stack would not be stable because of the small size and configuration of the male and female connectors on the bases and lids.

Another prior art container system is shown and described in U.S. Pat. No. 4,951,832 and includes a plurality of containers and lids. Each lid is sized to fit only its associated container. The inner surface of each lid is contoured either to snap-fit over the open top or onto the bottom of its respective container. The different sized containers can be stacked in a nested configuration, one inside the other, while the lids remain attached to the bottom of the corresponding container. The lids can not be stacked together and the containers when full and in use can not be stacked on top of one another in a stable arrangement.

Yet another prior art container system is shown and described in U.S. Pat. No. 5,409,128 and includes stackable containers with lids. The containers have a first threaded segment on an outer surface near the open top adapted to engage with a first threaded segment on an inner surface of the lids so that the lids close off the open top of the container. Additionally, each lid includes a stepped portion of its top. The stepped portion includes a second threaded segment sized and shaped to mate with a second threaded segment formed within a lower rim of the container so that the lids can thread to the bottom of adjacent containers when stacked. A stable stack can be created, but the lids can not attach to one another for storage and the threaded connection method can be somewhat difficult to use, particularly with full containers.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
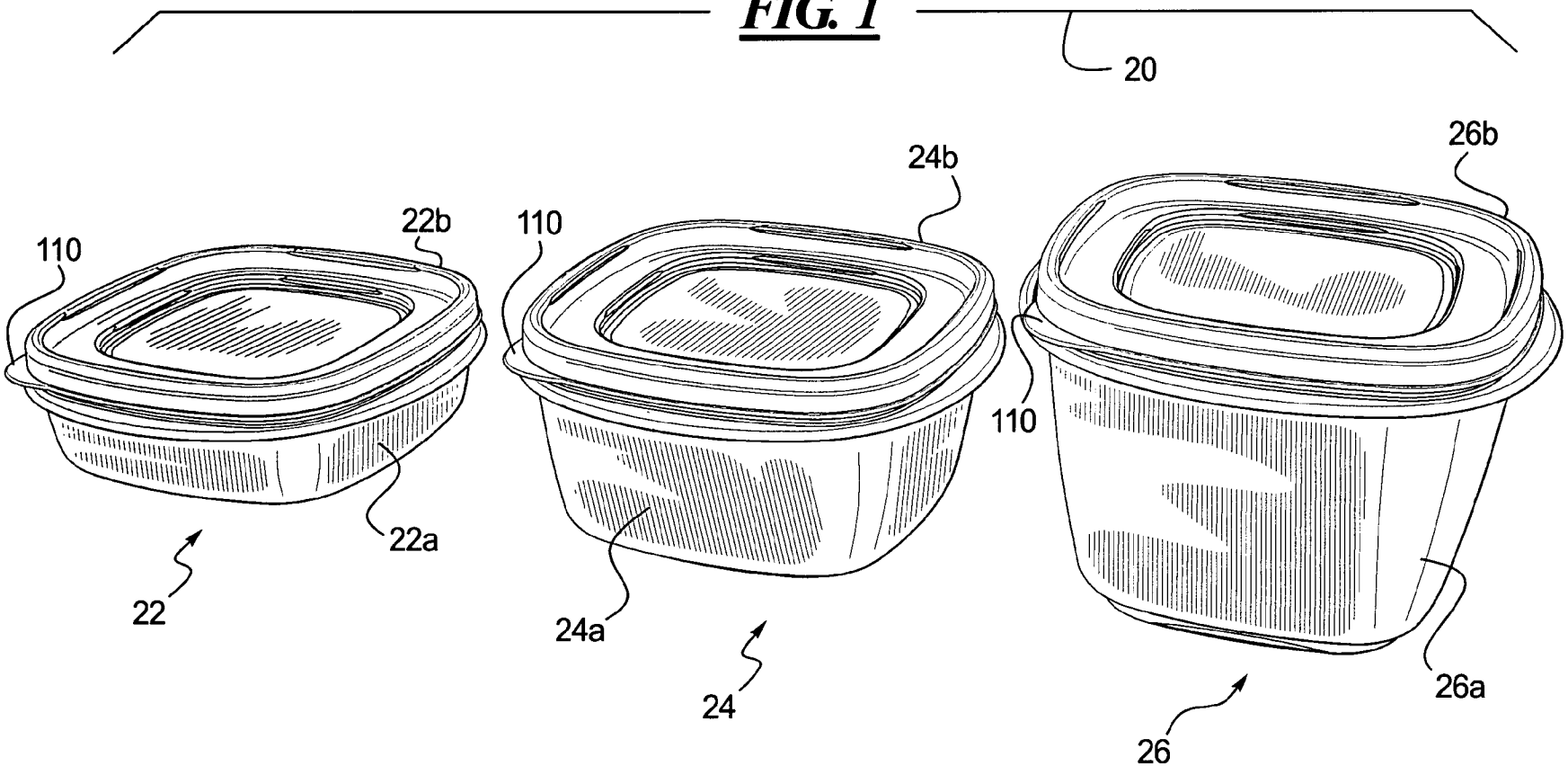
FIG. 1 shows a perspective view of a set of multiple storage containers having different storage capacities and constructed in accordance with the teachings of the present invention.

The present invention is for a storage container and a container system. The disclosed containers and systems solve or improve upon one or more of the above-noted and other problems with and disadvantages of currently known storage containers. The disclosed containers have a base and a lid. The disclosed systems include multiple container bases and lids. In one example, the lid and/or base can have connecting structures, one for snapping the lid to other like lids and/or another to snap the lid to the bottom of its base or another like base. In another example, the lid and/or base can have connecting structures, one for frictionally connecting the lid to other like lids and/or another to frictionally connect the lid the bottom of its base or another like base. The disclosed lids and bases can also be provided having one connecting structure providing a snap connection between two lids or a lid and base bottom and another connecting structure providing a friction connection between two lids or a lid and base bottom. The disclosed container bases can all have the same capacity, different capacities, or combinations and multiples of varying same and different capacities.

In one example, multiple container bases can be provided having varying storage space capacities with open tops that are identical in size and shape regardless of interior capacity. The lids can be identical one-size-fits-all or universal lids so that any lid can be used with any container base regardless of base storage capacity. In another example, the system can be provided having multiple different sized container bases, some of which have different sized open tops. In such an example, at least the container bases of the same open top size and shape can have a lid that is sized to fit the associated container bases. In each example, the bases and/or lids can be snapped or frictionally connected together in various configurations either during use to store food items or during non-use. The disclosed container bases and lids can be formed of a generally or substantially rigid plastic material and retain the same size and shape whether in use or not. Portions of the disclosed lids and bases can alternatively be made of a somewhat flexible thermoplastic elastomer (TPE) or like material.

The lids of the disclosed systems include a first connecting structure with mating lid-to-lid components that allow for a lid-to-lid connection. The lids and bases also include a second connecting structure including a different lid-to-base component on the lids that cooperates with a mating lid-to-base component on the container bases to provide a lid-to-base bottom connection. The lids and container bases can be connected together in a variety of configurations. Each lid also has a seal feature so as to fit over the top of the container base and seal the storage space of the base. Multiple lids can be connected together to keep the lids together when not in use. In another example, a single lid may be connected to the bottom of an associated container base to keep the lid and container base together. In yet another example, multiple lids may be connected together to form a stack that is then connected to the bottom of either a single container base or multiple container bases nested and stacked together. In still another example, a container sealed with a lid can be connected to a lid of another container base sealed with a lid. In another example, the disclosed container bases can also be nested together regardless of base volume.

Currently known plastic storage containers are typically stored in a kitchen cabinet or pantry area when not in use. However, many homes are not equipped with adequate storage space, especially for kitchen and food related storage items. Most users have a variety of container sizes with associated lids that are sized and shaped to fit a particular container to seal the container when in use. Currently known plastic storage containers typically take up a large amount of cabinet storage space since the container bases and lids are fairly rigid. A typical user may store the container bases and lids separately in the cabinet or pantry. Users often complain that the containers and lids become separated in the cabinet or pantry, requiring time and effort to find the lid that matches the desired container. Even when a base and lid organizer or rack is employed, it can still be difficult for a user to find a desired base and the appropriate lid for that base. Some users store their containers in a lid-on condition so that the containers may be stacked and the lids readily located. However, many cabinets and pantries are not tall enough to allow more than two such assembled containers to be stacked, requiring the stacked containers to be stored in a side-by-side condition. This method takes up a lot of shelf space in the cabinet or pantry and leaves significant cabinet or pantry storage space unused.

During use, plastic food storage containers hold food items and either are stored in a refrigerator or are transported to venues outside the home, such as, for example, to picnics, parties, pot luck dinners, or church socials. Users often employ more than one container to store or transport different food items and may stack the various containers. Stacking the full containers in a refrigerator, for example, provides organized storage. However, the stacked containers may slide around, slide off of one another, tip and fall, or otherwise become separated from each other. This can create spills or a cluttered and unorganized refrigerator. Additionally, when in use, users typically stack and carry full containers during transport. However, the full containers can easily slip off of one another, tip and fall, and become separated. This makes it difficult to carry and load the full containers from the home into a vehicle and to carry the containers from the vehicle to the destination. Additionally, it can be difficult to prevent the containers from becoming separated and sliding around inside the vehicle during transport. This not only can make transporting the full containers difficult but also can create the possibility of food spillage.

The present invention overcomes these and other problems with prior known containers by providing a storage container system that includes one or more container bases and associated lids that have unique connecting structures. The unique connecting structures and arrangements are configured so that the container bases and lids can be stacked to form a small footprint and take up as little space as possible either in use while storing food items in a refrigerator or in non-use while being stored away in a cabinet or pantry. Additionally, the connecting structures allow the container bases and lids to be stacked together in a locked, stable, or secure manner to prevent separation to facilitate storage or transport during use.

Turning now to the drawings, FIG. 1 shows one example of the container system constructed in accordance with the teachings of the present invention. The disclosed system can include a set 20 of multiple containers 22, 24, and 26. Although the set 20 is shown to include three containers, the invention is not limited to only three containers and may include fewer or more than three containers in the set. Also, the system can include multiple containers of the same size or can include containers of different storage capacity but utilizing a common lid size as shown in FIG. 1. In another example, the system can be provided with some containers of the same size, some of different storage capacity but with common lids, and some of different size and shape.

Each container 22, 24, and 26 of the disclosed example includes a container base and a lid. For example, the container 22 includes a base 22*a* and a lid 22*b*. Likewise, the container 24 includes a base 24*a* and a lid 24*b* and the container 26 includes a base 26*a* and 26*b*. The container bases in the set 20 in this example have various capacities to store different amounts of food items. For example, using the standard measuring cup capacity, the respective container base capacities can be of a three cup (container 22), five cup (container 24), and seven cup (container 26) storage capacity. However, these capacities are given only as examples and the invention contemplates containers having other storage capacities as well. While all of the bases 22*a*, 24*a*, and 26*a* can be of different interior capacities they are all of similar construction in this example. The lids 22*b*, 24*b*, and 26*b* are formed identically and are one-size-fits-all or universal so that any lid can fit onto any base.

The bases and lids of the set 20 are shown to be of a substantially square-like or generally rectangular cylinder shape. However, other shapes and configurations of the bases and lids, such as round or circular, are contemplated and are intended to fall within the scope of the invention. The invention is not to be limited to a specific container base and lid perimeter shape or overall contour.

Figure 2:
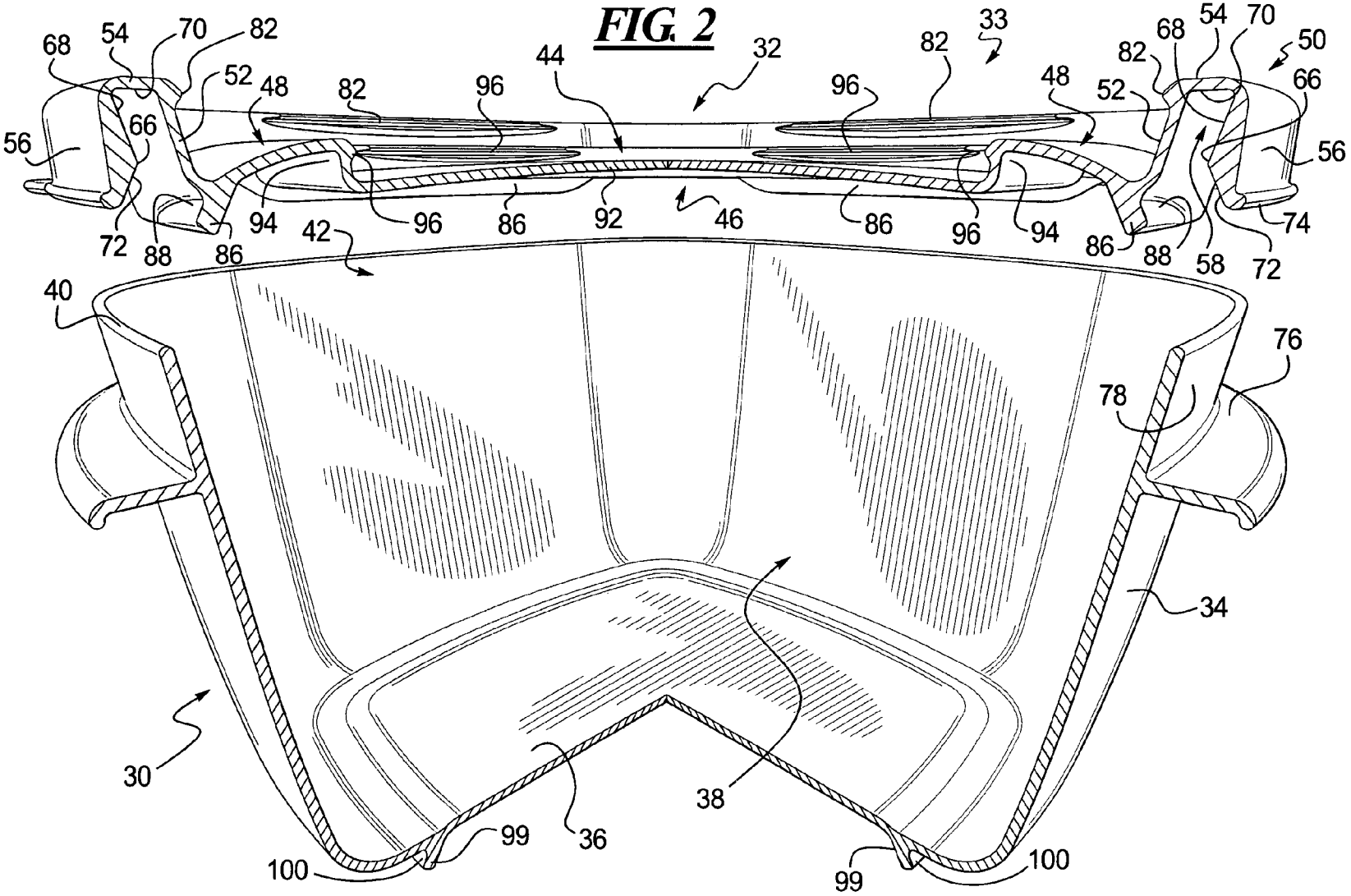
FIG. 2 shows an exploded view of a one quarter vertical cut-away section of a base and a lid that are representative of any one of the storage containers from the set shown in FIG. 1.
Figures 3A, 3B, 3C:
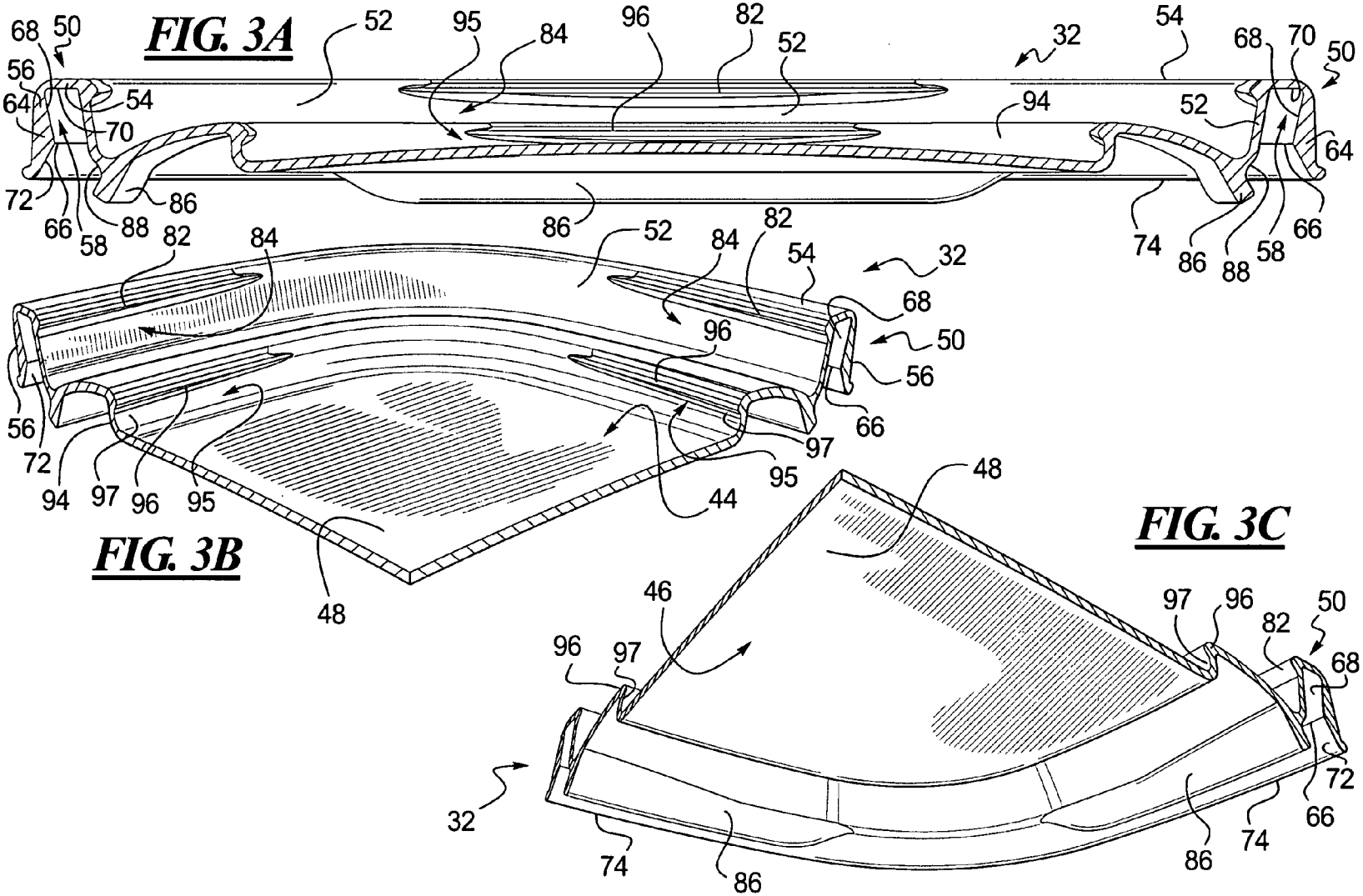
FIG. 3A shows a center vertical cross-section of the lid in FIG. 2.
FIG. 3B shows a top perspective view of a three quarter cut-away section of a corner of the lid in FIG. 2.
FIG. 3C shows a bottom view of the three quarter section of the lid in FIG. 3B.

Referring now to FIG. 2, structural details of a representative base 30 and lid 32 are shown. The representative lid and base include features that can equate to the features of any of the aforementioned containers 22, 24, or 26. The base 30 and the lid 32 can be used together as a representative container 33. The base 30 has a continuous side wall 34 and a bottom 36 that defines an interior storage space 38. In this example, the side wall 34 and the bottom 36 form a substantially square cylinder shape, but with rounded corners and a slight outwardly tapered side wall as are known in the art. As noted above, other shapes and configurations are contemplated and fall within the scope of the invention. The specific dimensions of the side wall 34 and the bottom 36 may vary yet remain within the scope of the invention as well. The side wall 34 extends upwardly and generally outwardly from a perimeter of the bottom 36 and terminates at a top edge 40 that defines an open top 42. The open top 42 of the base 30 in this example can be identical in size and shape, regardless of interior volume, to other containers of the system so that all lids fit all bases.

The lid 32 is formed with features that allow it to cover and seal the open top 42 of the container base 30. As shown in FIGS. 2, 3A-3C, 4A, and 4B, the lid 32 has a top side 44, a bottom side 46, a main panel section 48 and a perimeter skirt assembly 50. The skirt assembly 50 circumvents the perimeter of the main panel section 48 and in this example has a generally inverted U-shape in cross-section. As will be evident to those of ordinary skill in the art, the skirt can very in configuration and construction and yet fall within the spirit and scope of the present invention. In this example, the skirt assembly 50 has an inner wall 52 that extends generally normal or perpendicularly upward from the plane of the main panel section 48. The inner wall 52 continues into a top wall 54, which in turn continues to an outer skirt wall 56 that extends generally downward from the top wall 54. The outer skirt wall 56 is spaced from inner wall 52 and forms an annular channel 58.

Figure 4A:
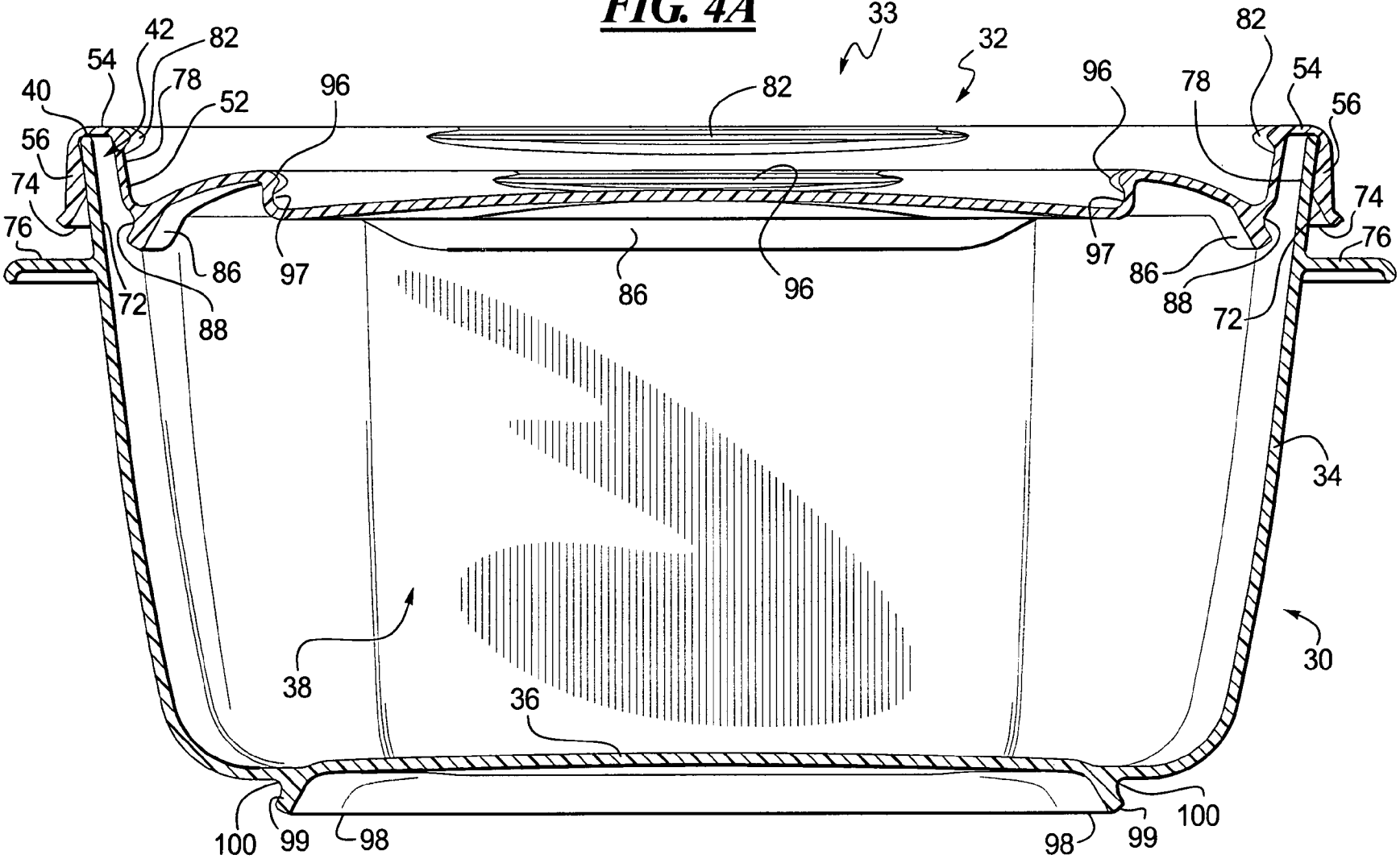
FIG. 4A shows a vertical center cross-section of the lid and base in FIG. 2 and with the lid attached over the open top of the base.
Figure 4B:
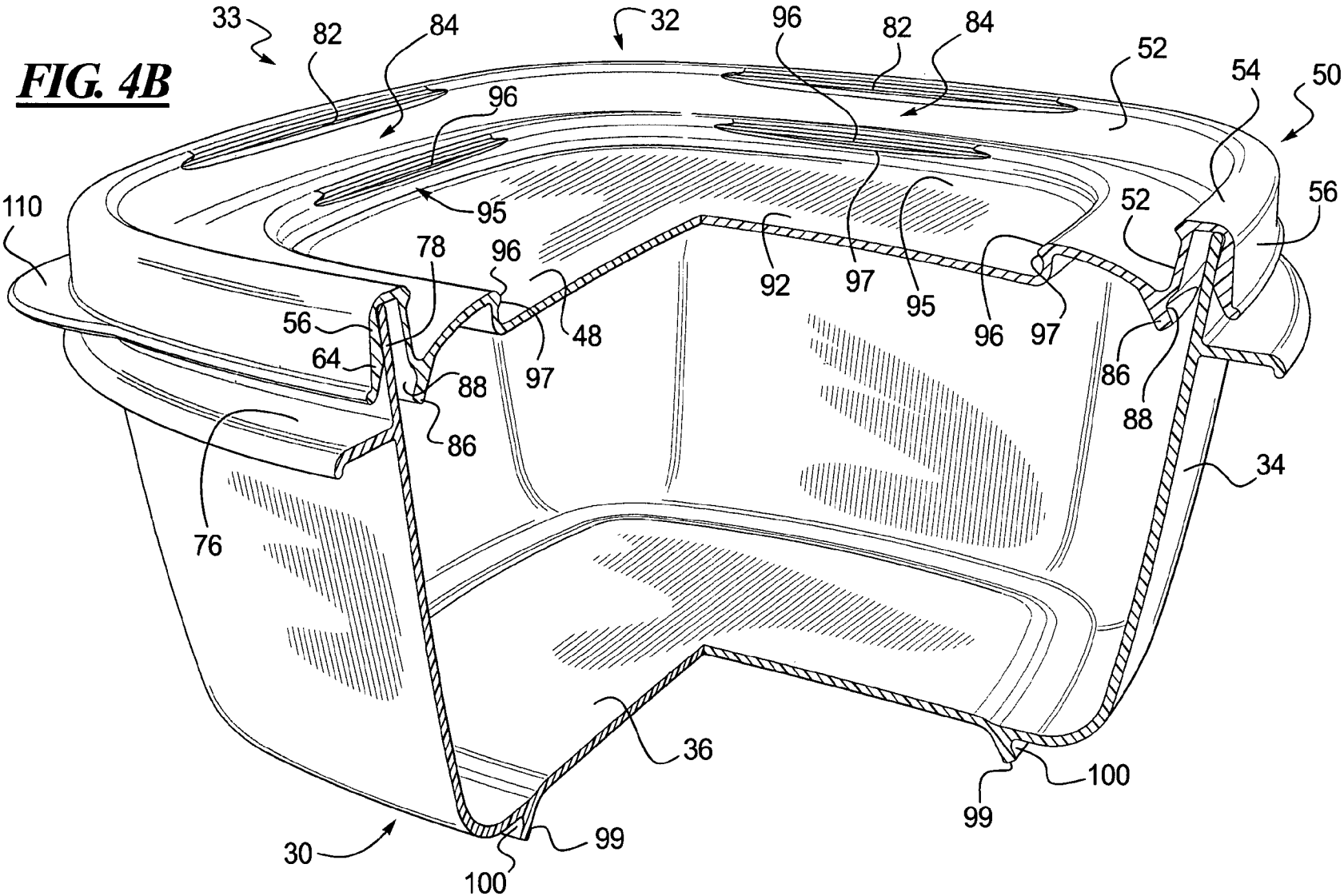
FIG. 4B shows a top perspective view of a one quarter cut-away section of the assembled container in FIG. 4A.
Figure 6A:
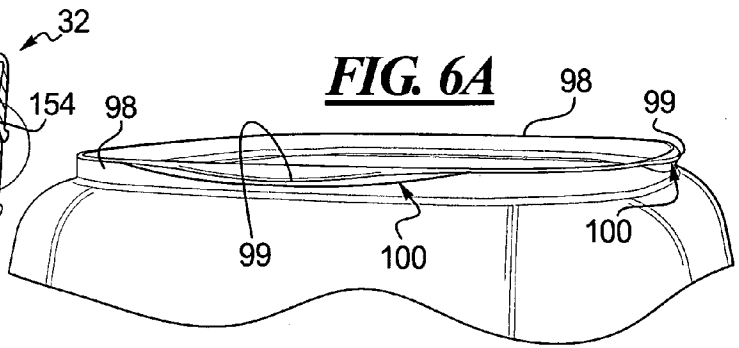
FIG. 6A shows a bottom view of the base of the container shown in FIG. 2.

As shown in FIGS. 4A and 4B, the lid 32 fits over the base 30 so that the top edge 40 of the side wall 34 is received within the channel 58. In this in use configuration, the lid 32 covers and closes off the open top 42 to seal the storage space 38. The top side 44 faces upward and the bottom side 46 faces downward into the interior storage space of the container 33. The shape and construction of the skirt assembly 50 can vary and yet remain within the scope of the invention. In addition, other lid-to-base seal configurations can be utilized on the storage container and container system components disclosed herein and yet fall within the spirit and scope of the invention.

In this example, the outer skirt wall 56 includes a gradually thicker portion 64 that is shaped to form an annular seal ridge 66 that extends radially inwardly around the inner surface of the outer skirt wall 56 and is coincident with the greatest thickness part of the thicker portion 64. An upper surface 68 is positioned above the ridge 66 on the inside of the outer skirt wall 56. Moving up from the ridge 68, the upper surface 68 is angled radially outwardly and meets an underside surface 70 of the top wall 54. A lower surface 72 is positioned below the ridge 68 on the inside surface of the outer skirt wall. Moving down from the ridge 68, the lower surface 72 is angled radially outwardly and meets a lower edge 74 of the outer skirt wall 56. The base 30 has an annular flange or rim 76 that extends radially outwardly from and circumferentially around the side wall 34. The rim 76 is located near the top edge 40 of the side wall 34, but spaced below the top edge. An upper portion 78 of the side wall 34 is thus defined above the rim 76 and is angles slightly radially outward. When the lid 32 is fit onto the base 30 to seal off the open top 42, the upper portion 78 of the base side wall 34 is received in the channel 58 of the lid 32. The ridge 66 of the thickened portion 64 and the upper surface 68 of the inside of the skirt wall 56 bear with some interference against the outside surface of the upper side wall portion 78. The top edge 40 of the base 30 and the underside surface 70 of the top wall 54 or the skirt are drawn toward one another to bear against one another by their relative cylinder sizes and the relative surface-to-surface interference. This creates a seal at the interface between the upper surface 68 on the skirt wall and the sidewall portion 78, as well as between the top edge 40 and the underside surface 70 of the skirt.

Figure 5:
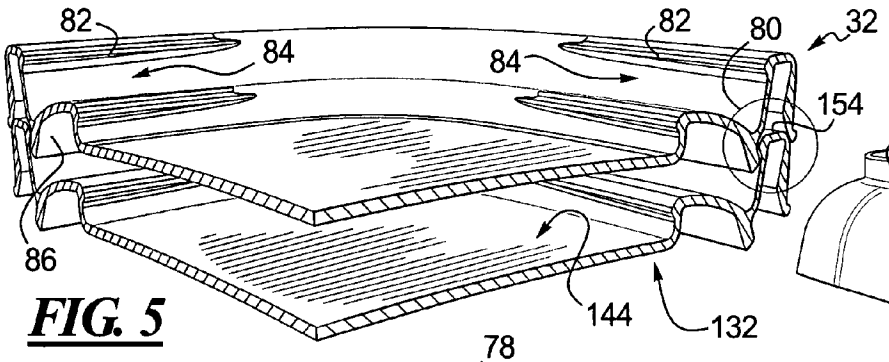
FIG. 5 shows a top perspective view of the three quarter cut-away section of the lid in FIG. 3B and connected to a like lid in a lid-to-lid stack.

As seen in FIGS. 3A-3C and 5, the lids 30 generally include lid-to-lid connecting structures. In this example, the lids 30 include a first snap structure 80 to allow lid-to-lid attachment for stacking lids. FIG. 5 shows the lid 32 attached to a second lid 132 forming a lid-to-lid stack of just two lids. Any number of like lids can be connected in a stack. The first snap structure 80 can be formed in a number of alternative ways that differ from the structures shown. In one example, the parts of the first snap structure 80 can be provided having an inverse part orientation from that shown, and yet remain within the scope of the invention.

In the disclosed example, the first snap structure 80 for lid-to-lid connection includes two components that mate with one another. Both components are provided as a feature of the lid structure. As shown in FIGS. 3A-3C and 5, one component of the first snap structure 80 is a plurality of lip or bead 82 formed on the top side 44 of the lid. In this example, four bead or lip segments 82 are positioned spaced apart around and extending radially inward from the inside surface of the inner skirt wall 52. In this example, the inner skirt wall 52 has four generally flat sections 84 created as a result of the generally square lid configuration and a bead segment 82 protrudes from each wall section 84. Each of the beads or lips 82 is positioned at the upper end of the inner skirt wall 52 near the intersection with the top wall 54 of the skirt assembly 50. Thus, each bead or lip 82 creates an undercut between the bead or lip and the main panel section 48 at the base of the wall 52 on each flat 84.

The mating component of the first snap structure 80 is on the bottom side 46 of the lid 32 in this example. The disclosed mating part includes four complimentary angled protrusions or ribs 86. Each rib 86 is positioned generally at the base of the inner wall 52 where the skirt meets the main panel section 48. Each rib 86 extends downward and is angled radially outward. A radially outward facing groove or recess 88 is thus formed on the outside facing surface of each rib 86 at the intersection between the rib and the underside of the lid at the base of the inner wall 52. The ribs 86 in this example are positioned beneath and aligned with the beads or lips 82 on the top side 44 of the lid 32.

As shown in FIG. 5, in order to stack two lids 32 and 132 in a lid-to-lid configuration the lips or beads 82 on the top side 144 of the lower lid 132 are forcibly and securely snapped into a corresponding one of the grooves or recesses 88 on the bottom side 46 of the upper lid 32 in the stack. The bottom edge 74 of the outer skirt wall 56 of the upper lid 32 rests against the top portion 154 of the bottom lid 132 when stacked.

In this example, each lip or bead 82 projects radially inward and each annular recess 88 faces radially outward on the representative lid 32 to receive one of the lips 88 of an adjacent lid. However, as noted above, this arrangement could be inverted and the details of the particular structures can vary from those shown. Alternative mating snap component structures can be utilized and yet fall within the spirit and scope of the present invention. For example, the lips or beads 82 can be formed having more or less than four segments and can be placed at different locations on the lid from that shown. Also, a continuous annular lip or bead can also be utilized, if desired. The same variations can be employed for the ribs or protrusions 82 and the grooves 88 as well.

As shown in FIGS. 6A, 6B, 7, and 8, the lids and bases generally include lid-to-base connecting structure for connecting the lids to the bottom of the bases. In this example, a second snap structure 90, which is different from the first snap structure 80, provides for a lid-to-base snap connection whereby a lid 32 is snapped onto the bottom 36 of a base 30. As seen most clearly in FIGS. 6A, 6B, and 8, a first component of the snap structure 90 is formed on the top side 44 of the lid 32 and a second component of the snap structure 90 is formed on the bottom 36 of the base 30. In one example, the first component of the snap structure 90 is created by a downwardly recessed region 92 in the main panel section 48 of the lid 32. The recessed region 92 is smaller than the perimeter of the main panel section 48 and thus is spaced inward from the inner wall 52 of the skirt assembly 50. A surrounding wall 94 transitions between the top surface of the recessed region 94 and the top side 44 of the main panel section 48. Similar to the first snap structure components, the surrounding wall has four generally flat sections 95 as a result of the substantially square lid configuration in this example. A plurality of protrusions 96 extend radially inward, one from each flat sections 95 of the surrounding wall 94, and define a plurality of undercuts 97, one below each protrusion. In this example, there are four protrusions and four undercuts.

The second component of the snap structure 90 is formed as a part of a foot or rib 98 that depends downward from the bottom 36 of the base 30. A plurality of flanges 99 in this example project radially outward from the bottom of the foot 98. Each flange 99 is positioned to coincide with the positioning of the undercuts 97 on the lid 32. The foot 98 in this example is a continuous annular rib on the base bottom 36, but can also be formed as a plurality of feet, each having one of the flanges extending therefrom. A channel 100 is formed facing radially outward between each flange 99 and the surface of the bottom 36 of the base 30. Again, the mating components of the lid-to-base snap structure 90 can also vary and yet fall within the spirit and scope of the present invention. The features as disclosed herein can also be inverted and placed on the opposite parts.

Figure 6B:
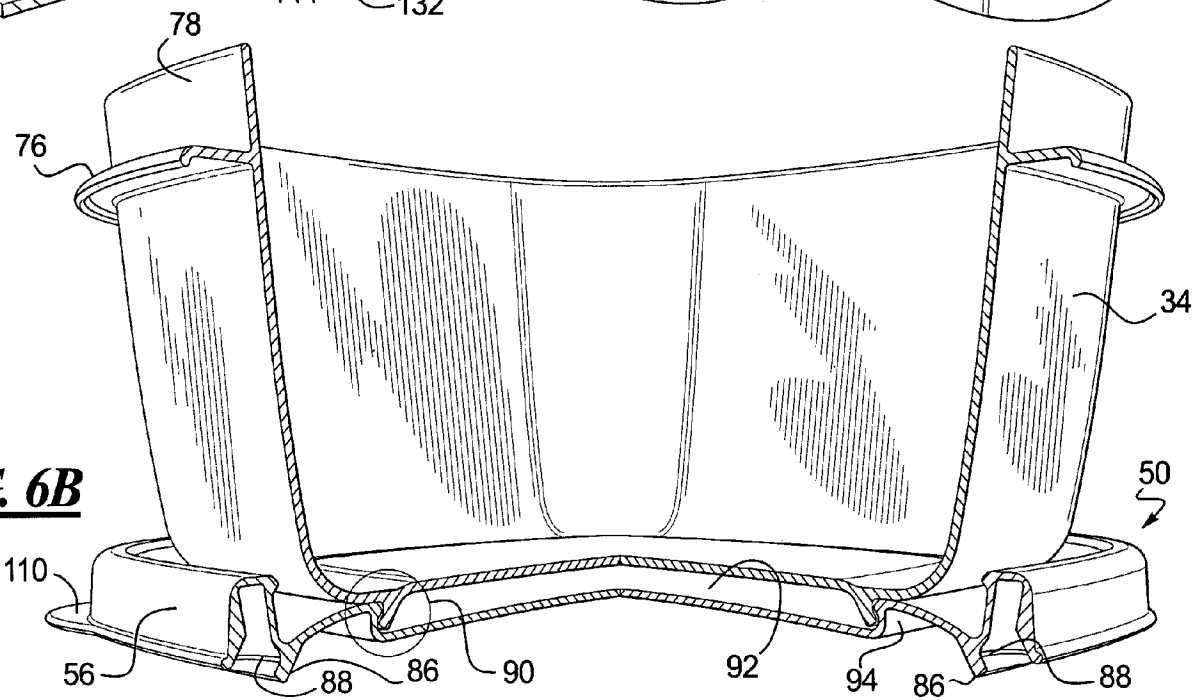
FIG. 6B shows a corner perspective view of a one quarter cut-away section of the lid and base in FIG. 2 and with the lid snapped onto the bottom of the base.
Figure 8:
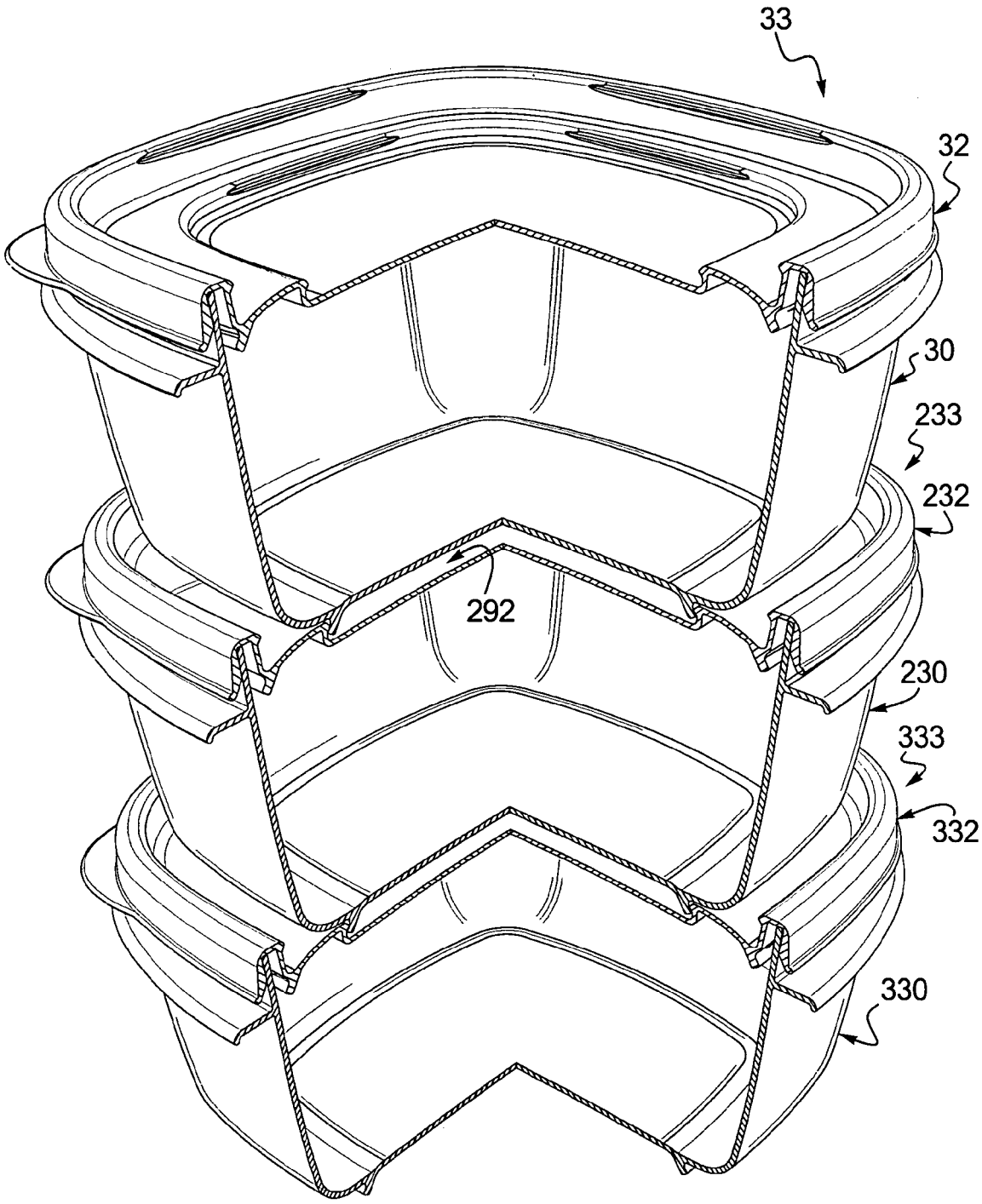
FIG. 8 shows a top perspective view of a one quarter cut-away section of three assembled containers as in FIG. 4B and stacked on top of one another.

As shown in FIG. 6B, when a lid 32 is snapped to a base bottom 36 the protrusions 96 on the lid 32 cooperate with and are received in corresponding ones of the channel 100 on the base. Also, the flanges 99 on the foot 98 of the base bottom 36 are simultaneously received in the undercuts 97 to provide a snap fit connection between base bottom and lid. More specifically, as best shown in FIG. 8, the flanges 99 and foot 98 on the base 30 are interferingly forced into the recessed region 92 on the top side 44 of the lid. The flanges 99 snap into the undercuts 97 and the protrusions on the lid snap into the channels 100 on the foot 98. The overlapping interference in the radial direction of the flanges 99 and the protrusions 96 holds the lid 32 attached to the base 30.

Figure 7:
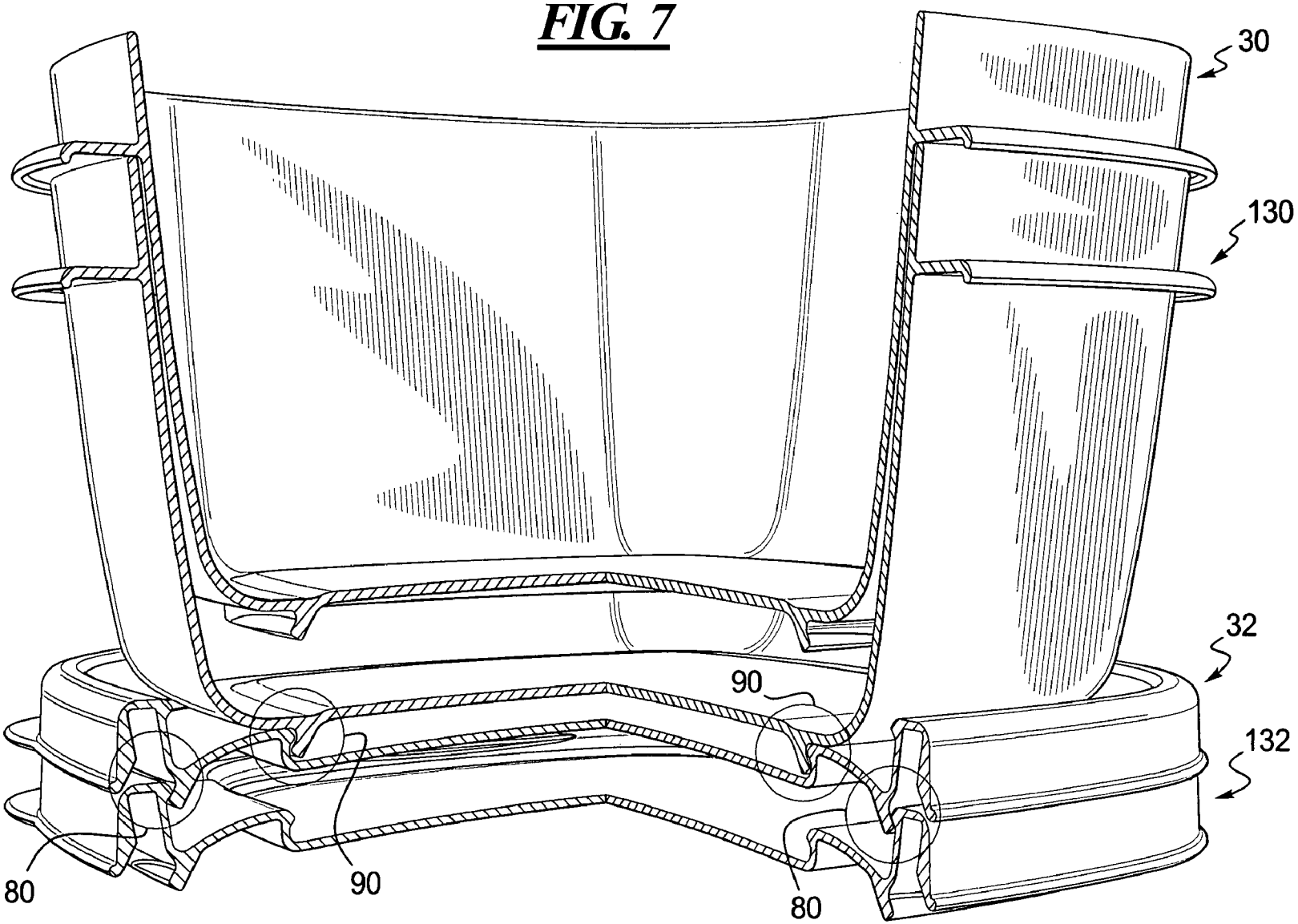
FIG. 7 shows a corner perspective view of a one quarter cut-away section of two bases as in FIG. 2 stacked together and two stacked lids as in FIG. 5 attached to the bottom of the base stack.

Multiple lids and bases can be used together in a variety of configurations. For example, as shown in FIG. 1, a lid can be coupled to the top of a single base for use as a sealed storage container. For example, the single container 24 includes the single base 24*a* and single lid 24*b*. Another configuration is shown in FIG. 7, in which multiple assembled containers 33, 233, and 333 are connected to form a stable stack of containers. The container 33 includes the base 30 and the lid 32. Likewise, the container 233 includes the base 230 and the lid 232 and the container 333 includes the base 330 and the lid 332. The stack is formed by snapping the flanges 99 of the foot 98 of one base into the recessed region 292 of an adjacent lid 232 and so on. The stack in FIG. 7 may be formed of multiple containers of any combination of different sizes or multiple same sized containers as is shown. This construction allows a full container with its sealed lid to be snapped on top of the sealed lid of another full container. This facilitates transport of multiple, full containers stacked on top of one another without the containers on top sliding off those below.

In another example shown in FIG. 8, individual bases without lids can be nested to form a nested base stack for storage. For example, one base 30 can be nested within an identical same size base 130. The nested base stack can be formed of nested same-size bases or bases of different graduated or non-graduated sizes. Nesting smaller capacity bases within larger capacity bases provides for more efficient use of storage space, but the container bases can be stacked and nested as desired. The nested base stack can also be connected to one or more stacked lids 32 and 132 that are snapped onto the bottom of the lower-most base. For example, a stack of the lids 32 and 132 can be snapped together and snapped onto to bottom of the lowermost base 130 of the nested base stack.

In another example, the lids may be formed with a finger grip structure to facilitate removal of a lid secured to a base covering the open top. For example, a finger grip tab 110 can be formed to extend radially outwardly from the outer lower edge of the skirt assembly 50 on the container 33. The finger grip can be formed as a tab 110 only along a portion of the skirt assembly, such as on a corner of the square lids as shown herein, or can extend entirely around the skirt. In yet another example (not shown), a finger grip structure can be formed generally by extending a part of the skirt outer wall 56 generally radially outward.

In the example shown and described above, the container bases are of varying capacities with open tops that are identical in size and shape regardless of interior capacity. The lids are identical one-size-fits-all or universal lids. However, this invention can encompass a container system in which some different sized container bases have different sized open tops with lids sized only to fit a particular associated container base top opening size. However, the various lid-to-lid and lid-to-base connecting structures can be formed to allow the different sized lids and/or bases to connect to any size lid or base. In another example, a system can be provided with several series of container base sizes. Each series can have bases with different capacities but the same size and shape top opening. Another series of that system can be provided with bases of different capacities and with top opening sizes and shapes that are common to one another but different from the other series.

Figure 9:
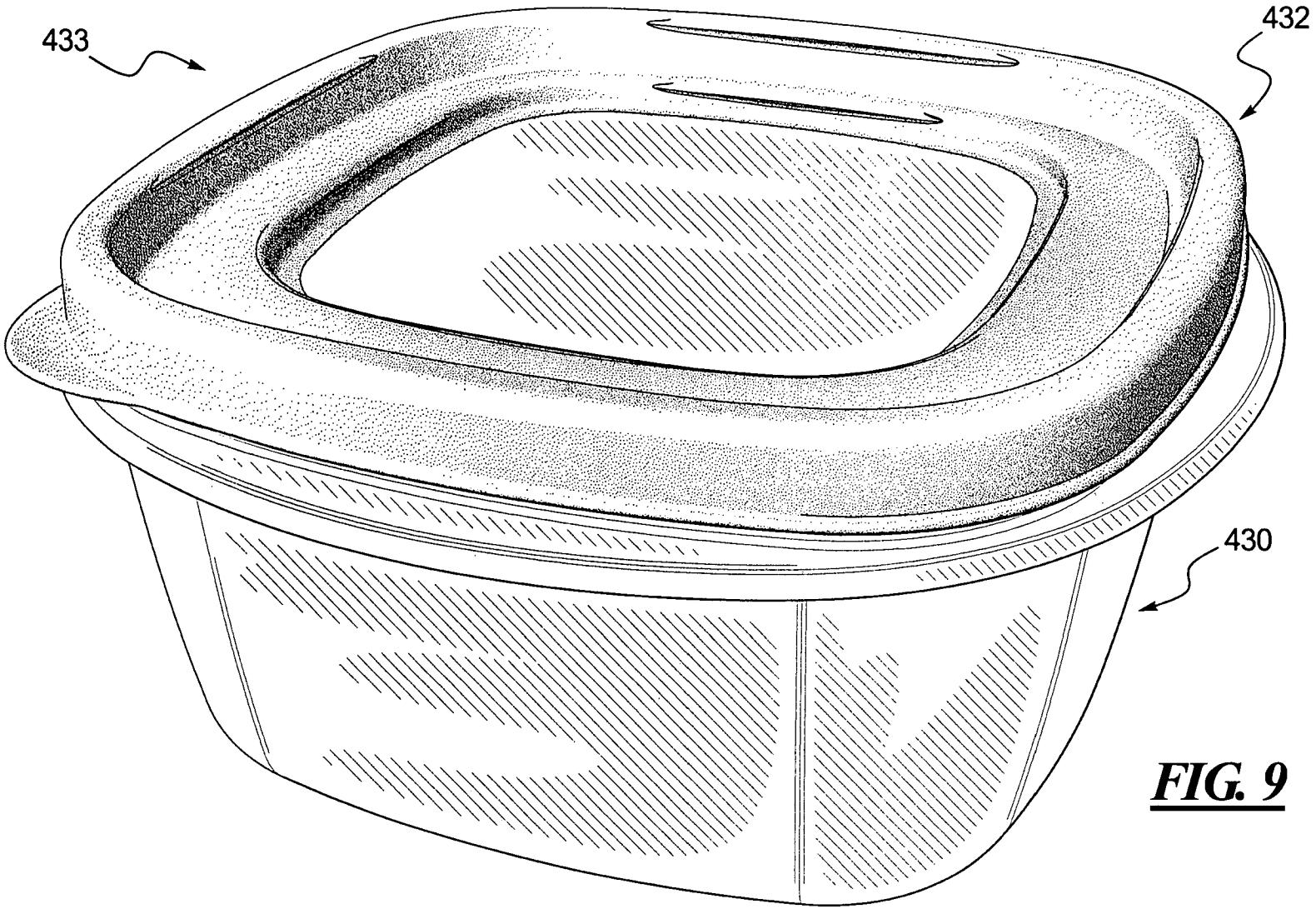
FIG. 9 shows an alternative embodiment of a container constructed in accordance with the teachings of the present invention.

The bases and lids can be formed from any suitable material and can be fabricated using any suitable process or method. In one example as shown in FIGS. 1-8, the lids can be a one-piece injection molded polypropylene or polyethylene and the bases can be injection molded polypropylene. In another example as shown in FIG. 9, a lid 432 of a container 433 can be dual molded from two (or more) different materials as discussed below to achieve a number of different desired affects, such as improved functionality of the several connecting and seal structures, aesthetic appearance, or the like. A portion of the lid 432 can be fabricated from opaque and/or colored material and a portion can be fabricated from a clear, transparent, or semi-transparent material. The two materials can have different textures, flexibility characteristics, surface friction characteristics, and the like.

A base 430 of the container 433 can also be dual molded from multiple different materials if desired, and for the same reasons. For example, the majority of the side wall and bottom can be formed from a substantially rigid, clear, transparent, or semi-transparent material. A portion of the base, such as the bottom foot or rib (described above) and/or parts of the rim or side wall can be formed from a different opaque and/or colored material to achieve improved seal and connecting functionality and a desired aesthetic appearance. Alternatively, the base 430 as shown can be molded entirely of a single clear, transparent plastic material. Other materials can certainly be utilized to fabricate the bases and/or the lids as disclosed herein.

Figure 10:
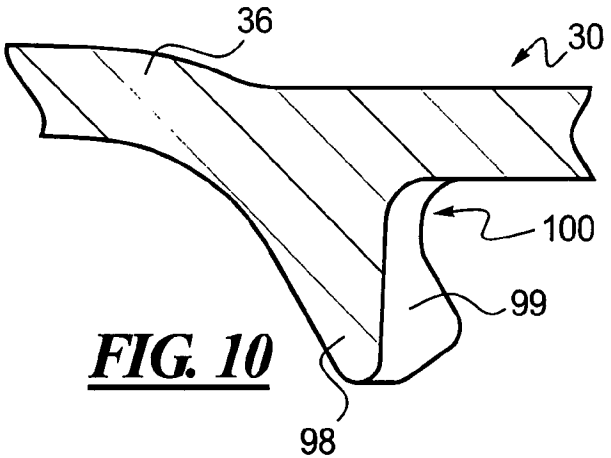
FIG. 10 shows a close-up cross-section taken along line X-X in FIG. 2 of the lid-to-base connector component on the bottom of the container base in FIGS. 2 and 4A.

Referring now to FIGS. 10-15, alternate examples of lids, bases, and connecting structures are depicted and described accordingly. In order to compare and contrast examples, FIG. 10 shows a close-up of a portion of the base 30 in cross-section. Specifically, a section of the rib or foot 98 of the bottom 36 of the base 30 is illustrated. The foot 98 depends down from the bottom 36. In this illustration, the section is not taken from the center of one of the sides of the base 30. Thus, the projecting flange 99 is illustrated, but not in section. The channel 100 is clearly depicted as positioned between the flange 99 and the bottom 36 of the base 30. The foot 98 and the flange 99, including the channel 100, cooperate to create the lid-to-base mating component of the second snap structure 90 described above.

Figure 11:
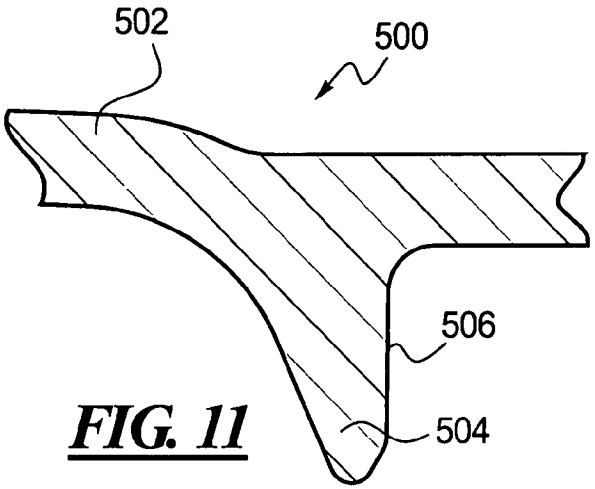
FIG. 11 shows a close-up section, similar to FIG. 10, but of an alternate example of a lid-to-base connector component on the bottom of the container base and constructed in accordance with the teachings of the present invention.

As noted above, the lid-to-base connecting structure can vary from the snap structure described in the previous embodiment. With reference to FIG. 11, a portion of a modified base 500 is illustrated in a manner similar to the base 30 in FIG. 10 except that this section would be a center section through the base. The base 500 in this alternate example is essentially identical to the base 30, except in that the lid-to-base mating component of the second connecting structure has been modified. In this alternate example, the base 500 has a bottom 502 and a rib or foot 504 depending downward from the bottom in the same manner as the foot 98 of the earlier example. In this example, an exterior or radially outward facing surface 506 is essentially vertical and flat in the vertical direction. As in the prior example, the foot or feet 504 can be curved in a circumferential direction around the base. The earlier described flanges 99 have been removed in this alternate example. Also in this example, the base 500 can be made from a different material, such as a polycarbonate material. The base 500 can be clear or transparent so the user can view the contents within the container and yet the base 500 can be quite durable, stain resistant, and substantially rigid to create a higher quality, or high-end no duct impression.

Figure 12:
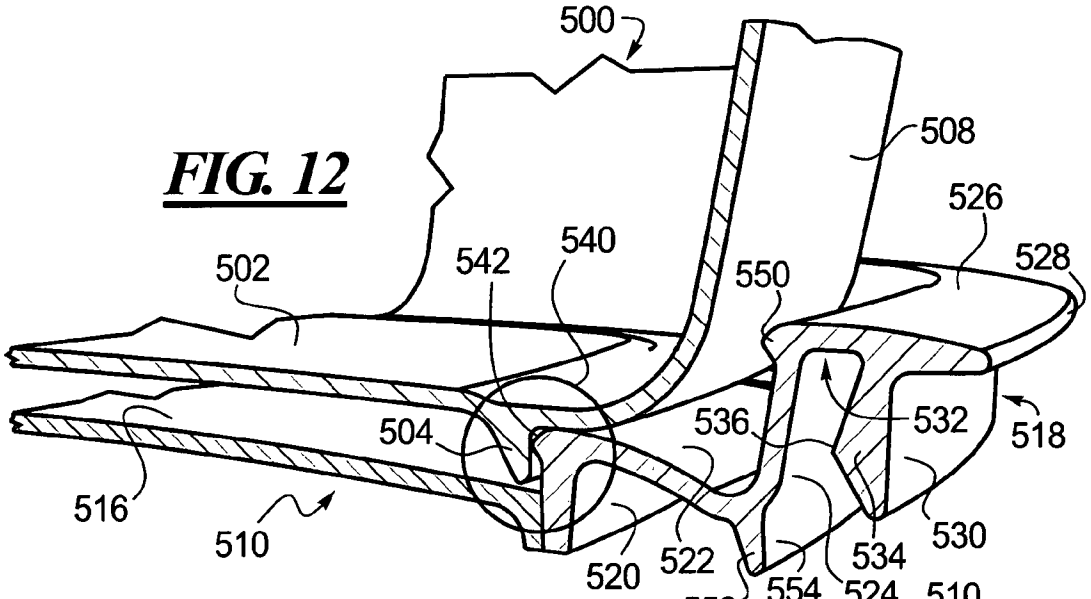
FIG. 12 shows a partial cross-section of an alternate example of a lid with the alternate lid connected to the bottom of the container base in FIG. 11.

With reference to FIG. 12, a greater portion of the base 500 is illustrated including a segment of the side wall 508 extending up from the perimeter of the bottom 502. Also with reference to FIG. 12, an alternate example of a lid 510 is illustrated connected to the bottom 502 of the base 500. In this example, the lid 510 also has a top side 512, a bottom side 514, a main panel section 516, and a perimeter skirt 518. The skirt 518 circumvents the perimeter of the main panel section 516. The alternate lid 510 in this example can be formed of two different materials. The main panel section 516 can be formed of a transparent polypropylene material, for example, so that a user can view contents within the container through the lid. The skirt 518 can be dual molded or co-molded with the main panel section 516 from an entirely different material. In this example, the skirt 518 can be formed from a relatively flexible TPE material or the like. Such a material can provide flexibility and resilience, can enhance gripping of the lid, and can allow for greater variation in product appearance and aesthetic characteristics.

With respect to the present invention, the alternate lid 510, including the flexible and resilient skirt 518, is used to disclose a different type of connecting structure between the various base and lid components of the container system. With reference again to FIG. 12, the skirt 518 has a generally vertically oriented inner wall 520 that extends generally normal or perpendicularly upward from a plane of the main panel section 516. A lower end of the inner wall is banded to the perimeter of the main panel section during the molding process. An upper end of the inner wall 520 transitions into a radially inner edge of a top wall 522. The top wall 522, at its radially outer edge, connects to a generally vertical middle wall 524. The middle wall 524 extends upward and transitions into a rim flange 526, which terminates at an outer rim edge 528 and which is position at a higher elevation than the top wall in this example. An outer skirt wall 530 depends downward from the underside of the rim flange 526 and is spaced radially inward from the outer rim edge 528 and radially outward from the middle wall 524. An annular channel 532 is formed beneath the rim flange 526 between the outer skirt wall 530 and the middle wall 524.

Though not described in detail herein, the lid 510 fits over the base 500 so that a top edge (not shown) of the side wall 508 is received within the channel 532, as with the prior example. The lid 510 covers and closes off the open top of the base 500 to seal its storage space. The top side 512 faces upward and the bottom side 514 faces downward into the interior storage space of the container. As in the prior example, the outer skirt wall 530 has a gradually thicker portion 534 that is shaped to form an annular seal ridge 536 that extends circumferentially around and radially inward from the inner surface of the outer skirt wall 530. As in the prior example, when the lid 510 is fit onto the base 500 to seal off the open top, the ridge 536 bears with some interference against the outer surface of the upper portion of the base side wall 508 when received within the channel 532 to seal the container. The resilient and flexible nature of the skirt material in this example can create a very good seal for the container with the ridge 536 born against a surface of the base 500.

Figure 13:
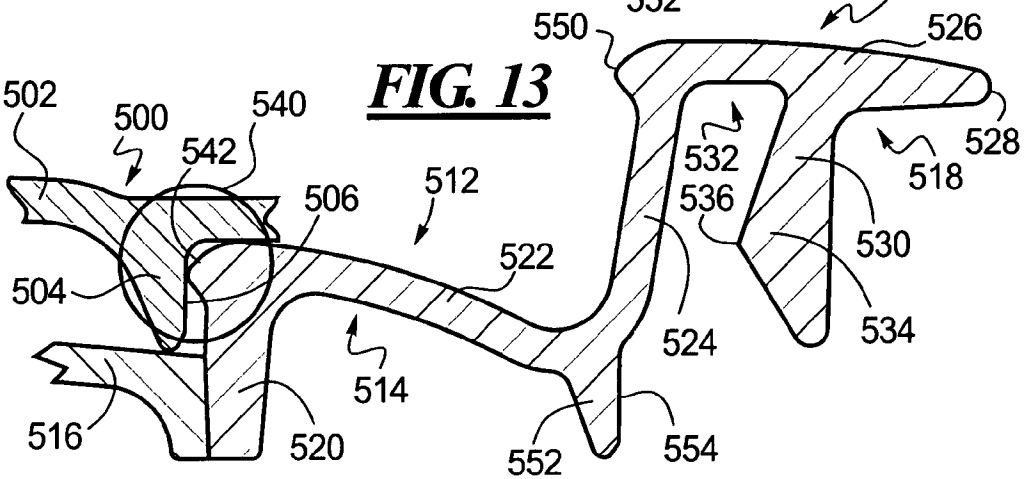
FIG. 13 is a close-up of the lid-to-base connector components on the lid and base depicted in FIG. 12.

As in the prior example, the base and lid can each be four sided and generally square or rectangular, or can each be round or some other shape. With reference to FIGS. 12 and 13, the alternate lid 510 includes three components for two different connecting structures, also as in the prior example. In this example, a lid-to-base connecting structure 540 is depicted generally in these figures. The lid-to-base connecting structure 540 incorporates a first component on the lid 510 and a second component on the base 500. In the previous example, the lid-to-base connecting structure created a snap fit connection. In this example, the lid-to-base connecting structure 540 creates a friction fit connection between the lid and base. As will become evident upon understanding the description below, a friction fit connection herein means that two objects fit tightly together via surface to surface interference. Surface to surface contact and/or compression of one or both of the two mating components created by dimensional tolerance control, i.e., interference fit, results in friction between the two connected parts. It is this friction that retains the two parts connected together instead of a snap-type connection.

The first lid-to-base connecting component in this example is provided in the form of a plurality of projecting lips or protrusions 542 that extend radially inward, one from each side section (not shown) of the four sided rectangular inner wall 520 on the skirt 518. One of the protrusions 542 is depicted in FIGS. 12 and 13 as protruding from a top of the inner wall 520 of one of the four side sections at the transition between the inner wall and the top wall 522. The protrusion 542 is resilient and flexible in that it is integrally made from the material of the skirt 518, which in this example is a TPE material.

The protrusions 542 in this example are very similar to the earlier described protrusions 96 of the prior example and can be employed as part of a snap or connecting structure utilizing the base configuration shown in FIG. 10, if desired. However, the mating or second lid-to-base connecting component in this example is provided by the vertically flat, radially outward facing surface 506 on the base rib or foot 504 depicted in FIG. 11. The relative size of the foot or feet 504 on the base 500, thus, and the position of the outer surface 506 in conjunction with the relative spacing of the protrusions 542 can be designed to create an interference fit between the protrusions and the surfaces of the foot or feet. Thus, as depicted in FIGS. 12 and 13, the foot 504 of the base 500 can be pressed or slid between the protrusions 542 on the top side 512 of the lid 510 to connect the lid to the bottom 530 of the base. A sufficiently high coefficient of friction created by the TPE material of the protrusions 542 against the polycarbonate material surface 506 on the foot or feet 504 will removably retain the lid connected to the bottom of the base in this example. The resilient and flexible lips or protrusions can be designed to compress and/or bend when connected to act as wipers in order to enhance the friction needed to keep the lid and base connected.

In another example, though not shown in the figures, the mating friction creating components can be reversed on the lid and the base. In other words, the inner wall surface 520 on the skirt 518 can be vertically flat and generally vertically oriented. Likewise, the protrusions can be provided on the exterior of the foot or feet 504. The protrusions on the foot in such an example can be flexible and can be formed by dual molding, over molding, or co-molding a TPE material on the bottom 502 of the base either to create a foot with protrusions or to create protrusions on the polycarbonate base foot. In the example of FIGS. 11-13, the foot 504 can be a single circumferential rib around the base bottom 502, or can be multiple feet arranged around the bottom. Hence the usage of foot or feet with respect to the rib or foot 504 depicted in these figures.

Figures 14, 15:
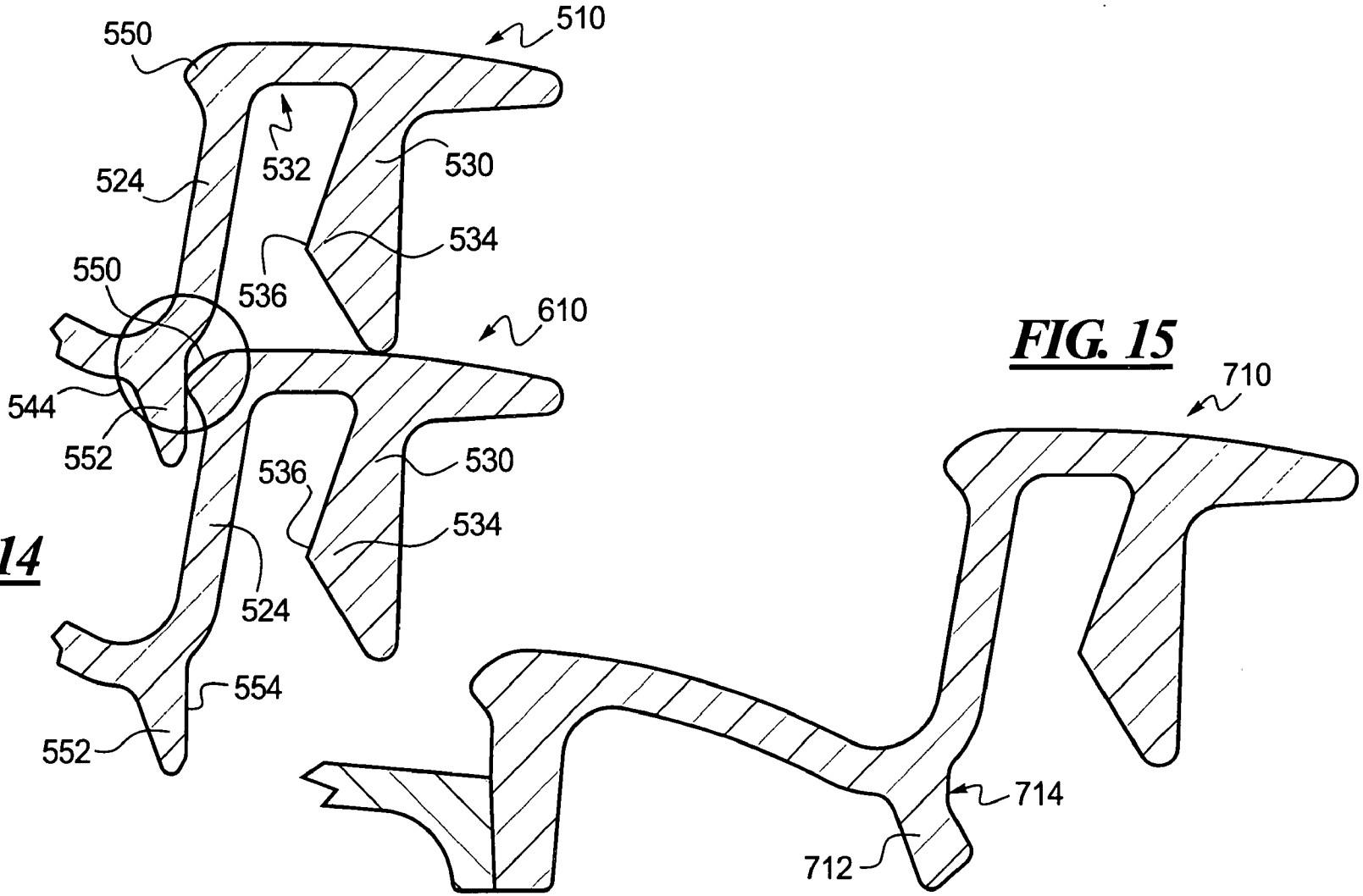
FIG. 14 shows a cross-section of portions of two lids connected to one another, each of the two lids being as shown in FIGS. 12 and 13.
FIG. 15 shows a close-up cross-section of a lid similar to the lid depicted in FIGS. 12 and 13, but with an alternate lid-to-lid connector component.

Referring now to FIGS. 13 and 14, the alternate lid 510 also includes a modified lid-to-lid connecting structure 544. Each of the lids 510 in this alternate example carries both a first lid-to-lid connecting component and a second lid-to-lid connecting component. In this example, the lid-to-lid connecting structure 544 also creates a friction fit connection between the lid 510 and a like lid 610 connected thereto, instead of a snap fit connection as in the prior example. In this example, the first lid-to-lid connecting component is comprised of a plurality of resilient, flexible protrusions or projections 550 also projecting radially inward on the lid. As before, only one of the protrusions 550 is illustrated, although at least one protrusion would be provided on each of the four side sections of the lid. The illustrated protrusion is positioned at or near the upper end of the middle wall 524 on its respective side of the skirt 518 at the transition between the middle wall and the rim flange 526. The protrusions 550 in this example are also flexible and resilient, as they are constructed from the TPE material of the skirt 518. In this example, the first lid-to-lid connecting component is also provided on the top side 512 of the lid 510.

In this example, a mating lid-to-lid connecting component is provided on a downward projecting rib or ribs 552 on the bottom side 514 of the lid 510. As with the foot or feet 504, the rib 552 can be a single continuous rib or multiple separate ribs. As depicted in FIGS. 13 and 14, the rib or ribs 552 extend downward from the transition joint between the middle wall 524 and the top wall 522 of the skirt 518. An outer surface 554 of the rib or ribs 552 in this example is constructed similarly to the outer surface 506 of the foot 504 in that this outer surface is generally vertical and flat in a vertical direction. This outer surface 554 on the lid 510 creates a friction bearing surface that engages the protrusions 550 on a like constructed lid, such as the lid 610, when connected together as shown in FIG. 14. As with the foot 504 on the base 500 and the protrusions 542 on the lid 510, the dimensions of these two mating or engaging components can be configured so as to create interfering engagement or an interference fit between the protrusions 550 on the one lid 610 and the ribs 552 on the connected lid 510. The resilient and flexible projections, as well as the ribs, can again be designed to compress and/or bend when connected to act as wipers in order to enhance the friction needed to keep two lids connected together.

As with the lid-to-base friction fit connecting structure 540, the bearing surface 554 and the resilient protrusion 550 of the lid-to-lid connecting structure 544 can be reversed on the lid and base, though not shown herein. In other words, the protrusions 550 can be replaced by a generally vertical, flat surface on the middle wall 524 of the skirt 518. Likewise, the ribs 552 can include a protrusion, bead, flange, or other configuration, such as in the previous example (or as shown in FIG. 15) to frictionally engage the generally vertical surface on the skirt middle wall 524.

As noted above with respect to the lid-to-base connecting structure 540 on the alternate lid 510, the alternate lid can also be designed to incorporate snap-like connections, similar to the prior embodiment, for lid-to-lid and/or lid-to-base connection. With reference to FIG. 15, a lid 710 can be configured essentially identical to the lid 510, except in that the downward depending rib or ribs 552 can include one or more protrusions 712 projecting radially outward from the outside surface of the ribs. The protrusions 712 can be spaced downward on the ribs 552 from the transition joint between the middle wall 524 and the top wall 522 to create a groove or recess 714 facing radially outward around the rib or ribs.

As with the earlier example, the protrusions 550 would seat in the groove or grooves 714 on the underside of the lid 710 when two like lids are connected. The protrusions 712 and grooves 714 alternatively can be configured similarly to the earlier described angled ribs 86 and the grooves or recesses 88 of the prior example. Thus, a snap fit connection could be provided to connect two like lids 710. This lid-to-lid snap connection can be utilized with either a friction fit connection structure for attaching the lid 710 to the base 500 or a snap fit connection structure for attaching the lid 710 to the base 30. As will be evident to those having ordinary skill in the art, the snap fit and friction fit arrangements, if both are used for the two different connecting structures, can also be reversed. In other words, the lids can be configured to snap onto the bottom of the bases, where as the lids can be configured to frictionally engage other like lids.

Other alternate examples are also possible within the spirit and scope of the present invention. For example, the lips and projections for the lid-to-lid and lid-to-base connecting structures on the lids can protrude radially outward instead of radially inward. Likewise, the mating friction engaging surfaces of the connecting structures on the lids and the base bottoms can face radially inward instead of radially outward. The connecting structures can be positioned differently on the lids and bases as well. The connecting structures can vary from the snap and friction examples shown and described herein.

By providing lids and bases with mutually exclusive connecting structures for lid-to-lid and lid-to-base attachment, the containers can be designed with greater variation in features. The components of one connecting structure can be placed where desired on the base and/or lid parts without affecting the design of the other connecting structure. The reverse is also true. Thus, greater design flexibility can be achieved in the container products. Also, the disclosed container system permits greater variation in functionality during use. The lids and bases can be stacked, organized, and maintained in a greater number of different alternatives when stored during non-use than are permitted by prior art designs. During use, the containers can be stacked in a stable fashion to prevent spillage and can be stacked, carried, and transported during use much easier than prior known containers and systems.

Although certain storage containers and container systems have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A storage container system comprising:

a plurality of container bases each having a bottom, a continuous side wall extending up from the bottom and terminating at a top edge, an interior storage space within the side wall above the bottom, and an open top bounded by the top edge;

a plurality of lids each having a main panel section, a perimeter skirt around the main panel section, a top side, and a bottom side, each of the plurality of lids configured to close off the open top of any one of the plurality of container bases by connecting a lid seal part of the perimeter skirt to the side wall near the top edge;

a first connecting structure on each of the plurality of lids, each first connecting structure having a first lid-to-lid component and a mating lid-to-lid component, each first lid-to-lid component configured to connect to the mating lid-to-lid component on any other one of the plurality of lids to connect any two of the plurality of lids together;

a second connecting structure different from the first connecting structure, each second connecting structure having a second lid-to-base component on each of the plurality of lids and a mating lid-to-base component on each of the plurality of container bases, each second lid-to-base component configured to connect to the mating lid-to-base component to connect any one of the plurality of lids to the bottom of any one of the plurality of container bases;

one or more feet that projects down from the bottom of each of the plurality of bases to form the mating lid-to-base component thereon, each of the one or more feet having an engaging surface facing radially outward that is generally vertically oriented and flat in the vertical direction;

a plurality of lips that are flexible and resilient, spaced around, and project radially inward from a portion of a wall that extends around the main panel section on the top side of each of the plurality of lids, the plurality of lips defining the second lid-to-base component of the second connecting structure, and wherein the plurality of lips frictionally contact a respective engaging surface on the one or more feet when one of the plurality of lids is connected to one of the plurality of bases, wherein the wall is an inner wall that extends up from a perimeter of the main panel section and is a part of the perimeter skirt, which also includes a top wall extending out from the inner wall and a middle wall extending up from the top wall and spaced radially outward from the inner wall.

2. A storage container system according to claim 1, wherein the lid seal part is different from the second lid-to-base component of the second connecting structure on each of the plurality of lids.

3. A storage container system according to claim 1, wherein relative storage capacities of the interior storage spaces of at least two bases of the plurality of container bases are different from one another whereas two respective lids of the plurality of lids for the at least two bases are the same size.

4. A storage container system according to claim 1, wherein the perimeter skirt of each of the plurality of lids has a continuous channel formed within an inverted generally U-shaped annular structure extending around a periphery of the main panel section, and wherein the continuous channel forms the lid seal part on each of the plurality of lids.

5. A storage container system according to claim 1, wherein the plurality of lips are formed of a thermoplastic elastomer material.

6. A storage container system according to claim 1, wherein the perimeter skirt further comprises a rim flange extending out from the middle wall and an outer skirt wall depending from the rim flange and spaced radially outward from the middle wall to form an inverted generally U-shaped channel around a periphery of the main panel section, wherein the channel forms the lid seal part.

7. A storage container system according to claim 1, wherein the one or more lips are positioned generally on an upper end of the inner wall adjacent the top wall of the perimeter skirt.

8. A storage container system according to claim 1, wherein the lid seal part is different from the first lid-to-lid component and the mating lid-to-lid component of the first connecting structure.

9. A storage container system comprising:

a plurality of container bases each having a bottom, a continuous side wall extending up from the bottom and terminating at a top edge, an interior storage space within the side wall above the bottom, and an open top bounded by the top edge;

a plurality of lids each having a main panel section, a perimeter skirt around the main panel section, a top side, and a bottom side, each of the plurality of lids configured to close off the open top of any one of the plurality of container bases by connecting a lid seal part of the perimeter skirt to the side wall near the top edge;

a first connecting structure on each of the plurality of lids, each first connecting structure having a first lid-to-lid component and a mating lid-to-lid component, each first lid-to-lid component configured to connect to the mating lid-to-lid component on any other one of the plurality of lids to connect any two of the plurality of lids together;

a second connecting structure different from the first connecting structure, each second connecting structure having a second lid-to-base component on each of the plurality of lids and a mating lid-to-base component on each of the plurality of container bases, each second lid-to-base component configured to connect to the mating lid-to-base component to connect any one of the plurality of lids to the bottom of any one of the plurality of container bases one or more ribs that depend downward from the bottom side of each of the plurality of lids forming the mating lid-to-lid component of the first connecting structure, each of the one or more ribs having an engaging surface facing radially outward that is generally vertically oriented and flat in the vertical direction, wherein a plurality of projections are flexible and resilient, spaced around, and project radially inward from a portion of a wall that extends around the main panel section on the top side of each of the plurality of lids, the plurality of projections defining the first lid-to-lid component of the first connecting structure, and wherein the plurality of projections frictionally and interferingly contact a respective engaging surface on the one or more ribs when one of the plurality of lids is connected to another of the plurality of lids.

10. A storage container system according to claim 9, wherein the one or more ribs and the plurality of projections are integrally formed as part of the perimeter skirt, which is formed of a thermoplastic elastomer material.

11. A storage container according to claim 9, wherein both the first lid-to-lid component and the mating lid-to-lid component of the first connecting structure are different from the second lid-to-base component of the second connecting structure, and wherein the first connecting structure permits the lid to be connected to another lid with a like first connecting structure.

12. A storage container according to claim 9, wherein the second lid-to-base component of the second connecting structure is positioned radially outward of the mating lid-to-base component of the second connecting structure.

* * * * *